US007036420B1

(12) United States Patent
Kummerer et al.

(10) Patent No.: US 7,036,420 B1
(45) Date of Patent: May 2, 2006

(54) PACK FOR CARRYING EXPLOSIVES AND INITIATORS

(75) Inventors: Anthony F. Kummerer, La Plata, MD (US); Earl Scroggins, deceased, late of La Plata, MD (US); by Debra M. Scroggins, legal representative, La Plata, MD (US); Lance A. Brown, Waldorf, MD (US); Christopher O'Donnell, La Plata, MD (US); Scott Strohman, King George, VA (US); William Transue, Indian Head, MD (US); Doug McDougal, Virginia Beach, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/807,573

(22) Filed: Mar. 18, 2004

(51) Int. Cl.
*F41H 1/02* (2006.01)
*A45F 3/06* (2006.01)
*F42B 39/00* (2006.01)

(52) U.S. Cl. ..... 89/36.07; 190/109; 190/125; 224/645

(58) Field of Classification Search ..... 86/50; 224/575, 153, 581, 582, 645, 652, 653; 89/36.07; 190/109, 111, 125, 127
See application file for complete search history.

(56) References Cited

U.S. PATENT DOCUMENTS

| | | | | |
|---|---|---|---|---|
| 5,005,679 | A | 4/1991 | Hjelle | |
| 5,136,119 | A * | 8/1992 | Leyland | 174/35 R |
| 5,214,873 | A * | 6/1993 | Sharber | 43/17.1 |
| 5,545,844 | A * | 8/1996 | Plummer et al. | 174/35 MS |
| 5,564,612 | A | 10/1996 | Gregory | |
| 5,567,055 | A * | 10/1996 | Smith | 383/38 |
| 5,646,364 | A * | 7/1997 | McClung et al. | 102/406 |
| 5,706,992 | A * | 1/1998 | Moor | 224/657 |
| 5,806,740 | A * | 9/1998 | Carlson | 224/628 |
| 5,874,688 | A * | 2/1999 | Lubbe et al. | 86/20.15 |
| 6,161,738 | A * | 12/2000 | Norris | 224/153 |
| 6,354,477 | B1 * | 3/2002 | Trummer | 224/575 |
| 6,419,132 | B1 * | 7/2002 | Reed et al. | 224/153 |
| 6,607,166 | B1 * | 8/2003 | Pichkhadze et al. | 244/138 R |
| 6,651,659 | B1 | 11/2003 | Izuchukwu | |
| 6,722,544 | B1 * | 4/2004 | Stephens et al. | 224/659 |
| 2003/0015559 | A1 * | 1/2003 | Oh | 224/153 |

FOREIGN PATENT DOCUMENTS

DE 19957963 A1 * 6/2001

* cited by examiner

*Primary Examiner*—Michael J. Carone
*Assistant Examiner*—Bret Hayes
(74) *Attorney, Agent, or Firm*—Fredric J. Zimmerman

(57) ABSTRACT

The invention, as embodied herein, comprises a back worn pack that allows a user to transport both energetic materials, such as primary explosives, and energetic initiators, such as blasting caps, within the pack without the threat of premature initiation of the energetic materials.

16 Claims, 5 Drawing Sheets

PACK FOR CARRYING EXPLOSIVES AND INITIATORS

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention pertains to transporting energetic materials, more particularly to human transport of energetic materials, and most particularly to safe human transport of energetic materials and energetic initiators.

2. Description of the Related Art

Explosive ordnance disposal technicians require energetic materials, such as explosives, as part of their standard equipment in disarming and/or disposing of unexploded ordnance. In order to employ these energetic materials in the field, energetic initiators, such as blasting caps for explosives, are also used. However, carrying both energetic materials and initiators for such materials poses a significant safety risk. If one of the initiators prematurely actuates, all of the energetic materials carried by the technician may be initiated.

Currently, to address this problem, explosive ordnance disposal technicians hand carry the energetic initiators separately from any energetic materials in metal containers. The metal containers work to contain a premature actuation of initiators and, because the containers are physically separated from the energetic materials, such as the initiators being carried in a technicians hand or attached to a different portion of the technician's body, the risk of prematurely initiating the energetic materials is reduced. However, such metal containers are heavy, currently about twelve pounds, and cumbersome and the requirement to carry such containers separately from the energetic materials is problematic for field use.

Therefore, it is desired to provide a device that allows explosive ordnance disposal technicians to efficiently carry energetic materials and energetic initiators together without creating a significant safety risk or increasing the weight carried by the technician.

SUMMARY OF THE INVENTION

The present invention comprises a back worn pack that allows a person to safely transport energetic materials, such as explosives, along with energetic initiators, such as blasting caps, in the same pack while allowing the person free use of both hands. Not only does the invention reduce the risks associated with transporting energetic materials and energetic initiators, but it also significantly reduces physical problems associated with current devices and methods of transporting such materials.

Accordingly, it is an object of this invention to provide a device to assist in safely transporting energetic materials, such as explosives, and energetic initiators, such as blasting caps, within one device.

It is a further object of this invention to provide a device to assist in transporting energetic materials and energetic initiators together that allows free use of a users hands.

A still further object of this invention is to provide a device to assist in transporting energetic materials and energetic initiators that does not significantly increase a user's carry weight.

This invention accomplishes these objectives and other needs related to safe transport of energetic materials and energetic initiators by providing a back worn pack comprising an energetic material section and an energetic initiator section. Both sections have means to be opened to place materials therein and, then, closed. The energetic initiator section is substantially surrounded by a fabric comprising at least one layer of a conductive material. The energetic initiator section also has a back panel between the sections having at least one layer of blast resistant and fragmentation inhibiting material.

In a preferred embodiment of the invention, an initiator containment panel is removably attached to the back panel. This initiator containment panel comprises at least one layer of blast resistant and fragmentation resistant material. A second fabric comprising at least one layer of blast resistant and fragmentation inhibiting material is attached to the initiator containment panel forming a plurality of initiator holder pockets. The plurality of initiator holder pockets are placed having one end adjacent to outer edges of the pack. A third fabric, placed adjacent to the outer edges of the pack so it substantially covers the outer bottoms of the plurality of initiator holder pockets also comprises at least one layer of blast resistant and fragmentation inhibiting material.

BRIEF DESCRIPTION OF THE DRAWINGS

The accompanying drawings, which are incorporated in and constitute a part of the specification, illustrate embodiments of the invention, and, together with the description, serve to explain the principles of the invention.

DESCRIPTION OF THE PREFERRED EMBODIMENT

The invention, as embodied herein, comprises a back worn pack that allows a user to transport both energetic materials, such as primary explosives, and energetic initiators, such as blasting caps, within the pack without the threat of premature initiation of the energetic materials.

In general, the invention is a pack with two main sections. The first section is designed to carry energetic materials and associated devices, tools, etc. This energetic material section is made of normal, sturdy, backpack material such as a nylon material. The second section is designed to carry energetic initiators. This energetic initiator section is constructed of materials and configured in such a way to avoid premature activation of one or more of the initiators. The energetic initiator section is also designed so that premature activation of one or more of the energetic initiators does not initiate the energetic materials stored within the energetic material section. These two missions are accomplished by using a combination of materials to construct the energetic initiator section that include at least one layer of a conductive material that surrounds the energetic initiator section and at least one layer of blast resistant and fragmentation inhibiting material between the energetic initiator section and the energetic material section of the pack. More preferably, multiple layers of blast resistant and fragmentation inhibiting material will be interspersed between regular pack material, such as nylon, as well as one or more layers of polycarbonate material which hardens when impacted by a projectile, placed between the two pack sections.

Figure 1:
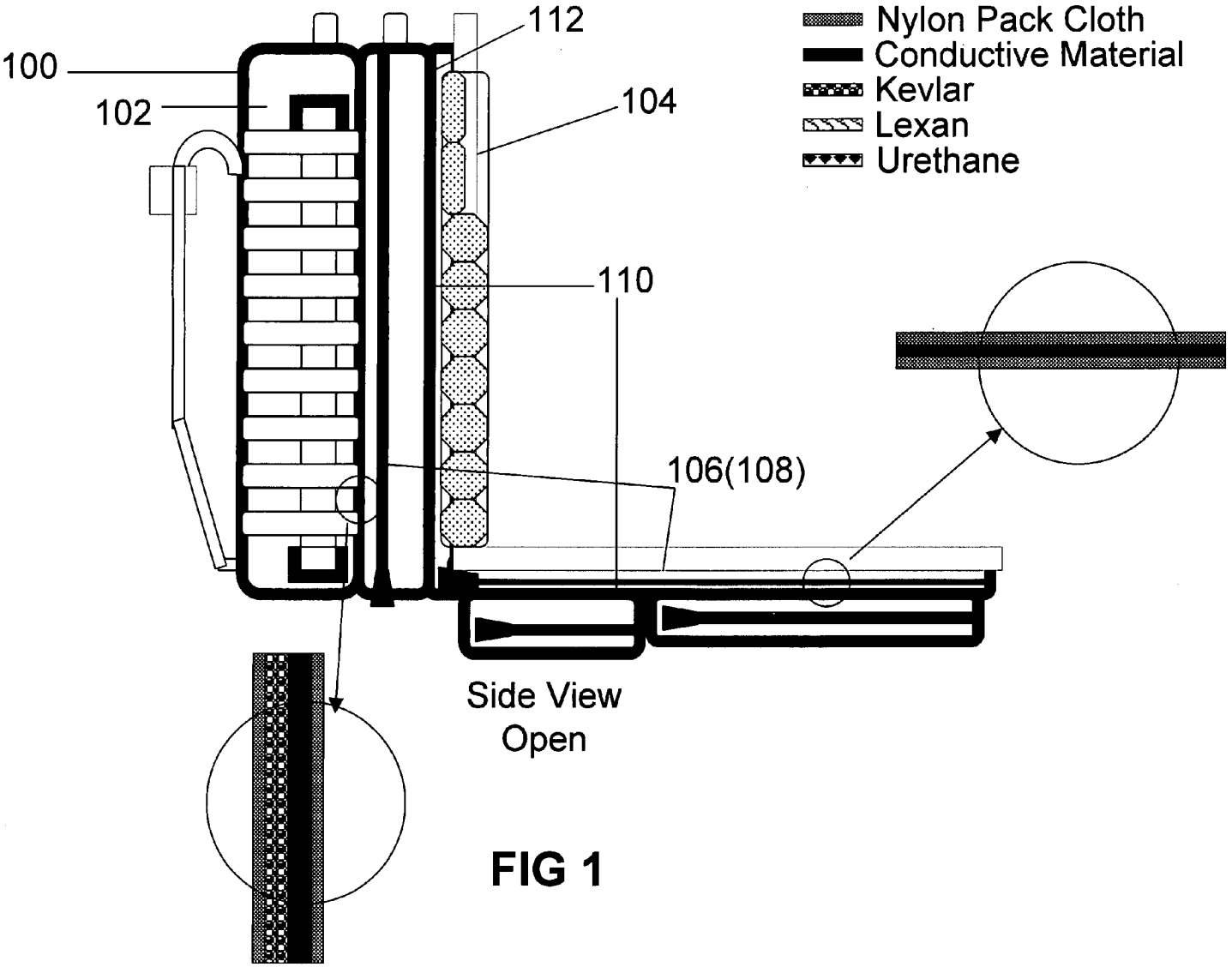
FIG. 1 shows a side view of an embodiment of the present invention with the energetic initiator section in an open position.
Figure 2:
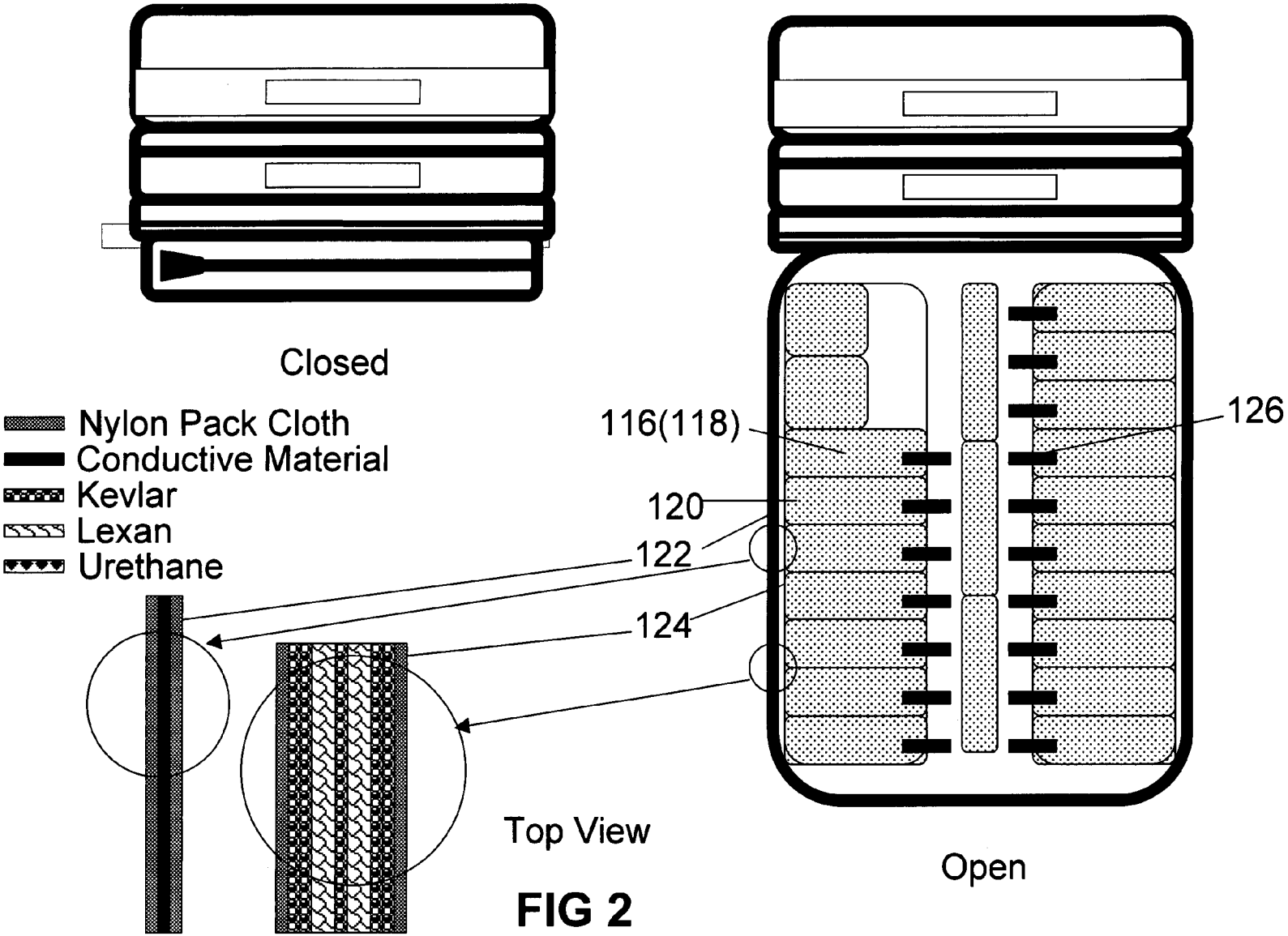
FIG. 2 shows a top view of the embodiment of the invention shown in FIG. 1.
Figure 3:
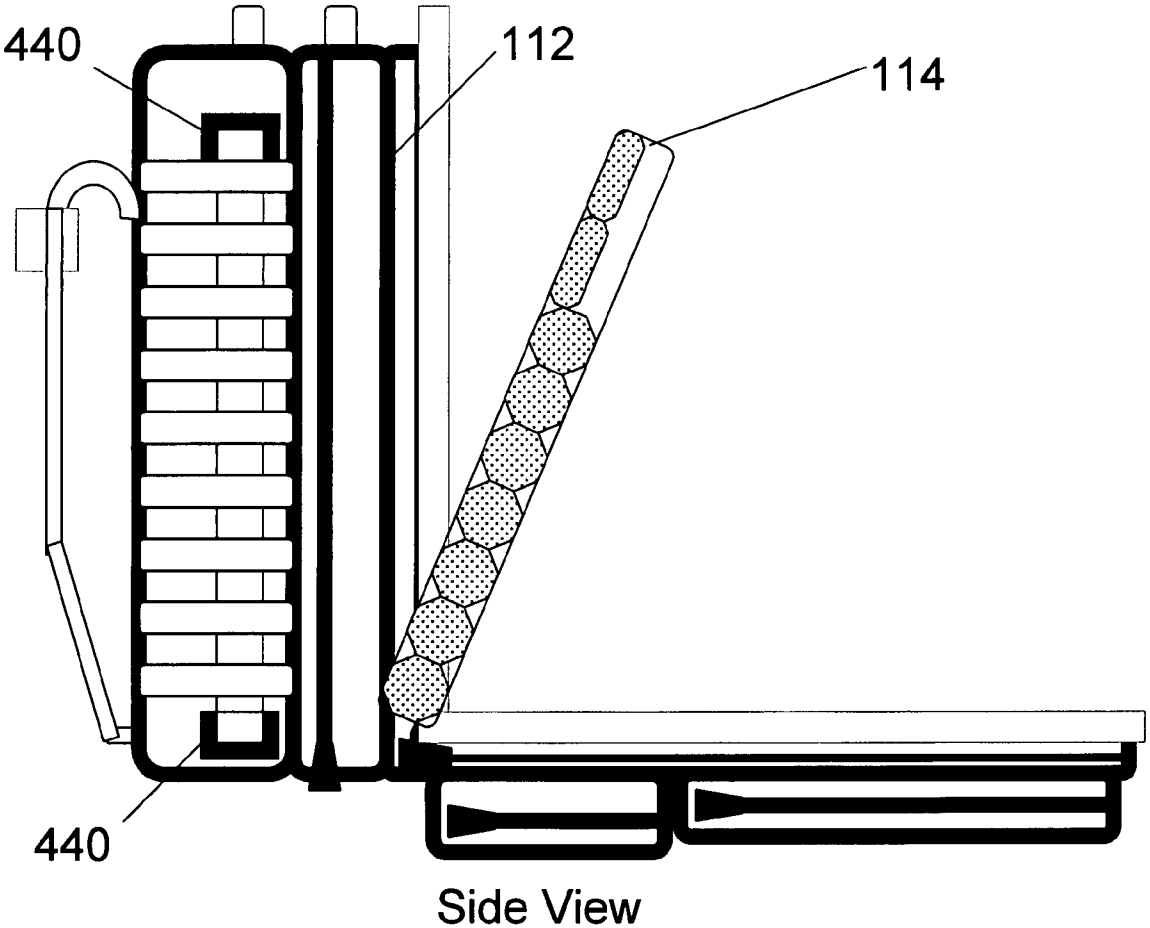
FIG. 3 shows a side view of the embodiment of the invention shown in FIG. 1 with the initiator containment panel partially removed from the pack.

Referring to FIGS. 1–3, the invention comprises a back worn pack 100 made up of an energetic materials section 102 attached to an energetic initiator section 104. Each of these sections has closure means 106 that may be opened and closed to provide openings 108 whereby one may place items into the sections 102, 104. The energetic initiator section 104 is surrounded by a fabric 110 that comprises at least one layer of a conductive material. The fabric 110 on a back panel 112, between the energetic materials section 102 and the energetic initiator section 104 also comprises at least one layer of blast resistant and fragmentation inhibiting material.

In a preferred embodiment of the invention, a cap containment panel 114 is removeably attached to the back panel 112. The cap containment panel 114 comprises at least one layer of blast resistant and fragmentation inhibiting material. A second fabric 116 is attached to the cap containment panel 114 to form a plurality of initiator holder pockets 118 wherein single energetic initiators are placed. The second fabric 116 also comprises at least one layer of blast resistant and fragmentation inhibiting material. The plurality of initiator holder pockets 118 will preferably be arranged so that a bottom 120 of the pockets 118 is substantially adjacent to an outer edge 122 of the pack 100 so that an initiator placed within a pocket 118 will not fall through the bottom 118. Along the inside of the outer edge 122 adjacent to the bottoms 120 of the pockets 118 and between the outer edge 122 and bottoms 120, a third fabric 124 also comprising at least one layer of blast resistant and fragmentation inhibiting material is attached.

The construction material of the outside of the pack 100 may be any normal pack 100 material, but is preferably nylon and most preferably 1000 dernier nylon. In a preferred embodiment of the invention, the fabric 110 surrounding the energetic initiator section 104 comprises a layer of conductive material sandwiched between two layers of the nylon pack material. When using the term conductive material, this refers to a material that can conduct electricity in such a manner to be resistant to electro-static discharge and electromagnetic interference that would cause initiators to prematurely activate. Examples of such a conductive materials include VELOSTAT® and MYLAR®.

The fabric 110 on the back panel 112, in order to provide greater protection between the energetic initiators and the energetic materials will preferably comprise two layers of blast resistant and fragmentation inhibiting material between the nylon along with the layer of conductive material. The blast resistant and fragmentation inhibiting material as used within this application are materials that prohibit products resulting from activation of an initiator from reaching energetic materials in the other section of the pack 100. Examples of such materials include KEVLAR®, SPECTRA®, and VECTRAN®. Preferably 1500 dernier KEVLAR® layers will be employed in the invention.

The cap containment panel 114 may be attached or removed from the back panel 112 for easy loading and unloading of initiators. One preferred attachment mechanism are hook and loop materials such as VELCRO®, but any method known in the art may be employed. The cap containment panel 114 will preferably be constructed of numerous layers of blast resistant and fragmentation inhibiting material interspersed with at least one layer of polycarbonate material which hardens when impacted by a projectile, along with the pack 100 material. Polycarbonate materials which harden when impacted by projectiles are commonly referred to as "bullet-proof" materials and are known as such in the art. One example of such a material is LEXAN®. It is preferred to employ ⅛ inch thick layers of LEXAN® in the invention. In a most preferred embodiment, the cap containment panel 114 will comprise two layers of a polycarbonate material which hardens when impacted by a projectile surrounded by four layers of blast resistant and fragmentation inhibiting material surrounded by two layers of nylon.

Figure 5:
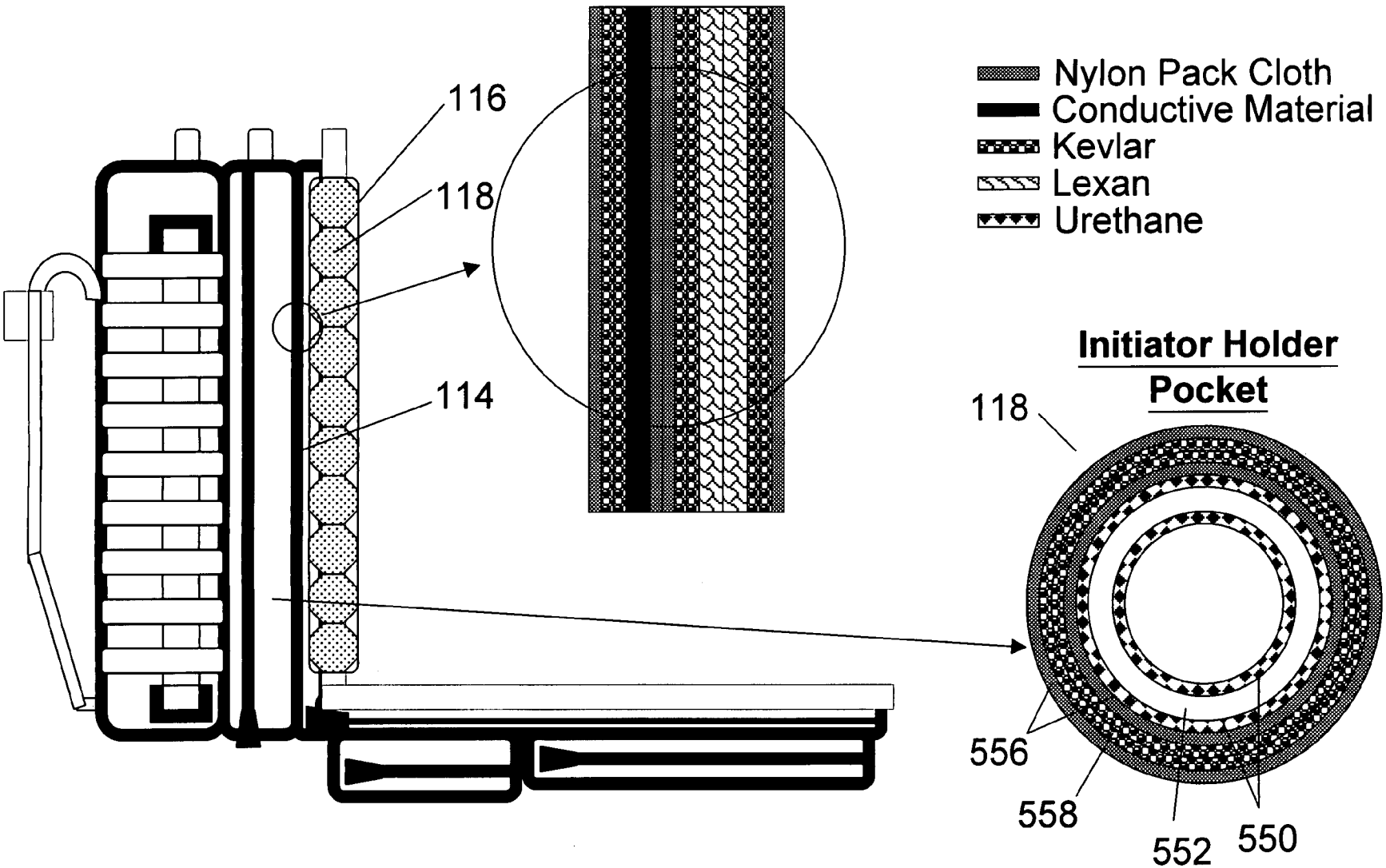
FIG. 5 is an embodiment of the invention including a top view of a cut-away of an initiator holder pocket.

The second fabric 116 is attached to the cap containment panel 114 to configure the plurality of initiator holder pockets 118 as noted above in order to place individual initiators within the pockets 118. In a preferred embodiment of the invention, a plurality of removable holder pocket tops 126 are removeably attached to the plurality of pockets 118 wherein the tops 126 keep the initiators within the pockets 118 until the initiator tops 126 are removed. The tops 126 may be constructed of the pack 100 material. The pockets 118 may be configured to hold numerous energetic initiators. When configured to hold blasting caps, it is preferable that the pockets 118 be tube shaped and located with the bottom 120 along an outer edge 122 of the pack 100. The blasting cap tip would be placed adjacent the bottom 120, so the additional protection from the third fabric 124, as described in greater detail below, may be concentrated at this location. Referring to FIG. 5, the initiator holder pockets preferably comprise two concentric plastic tubes 550 having an air gap 552 therebetween. In a most preferred embodiment of the invention, the pockets 118 further comprise two layers of a nylon material 556 having two layers of the blast resistant and fragmentation inhibiting material 558 therebetween and surrounding the outer plastic tube 550. Again, this configuration provides additional protection directly around the initiators.

Again referring to FIGS. 1–3, because the third fabric 124 is placed between the bottom 120 of the pockets 118 and an outer edge 122 of the pack 100, and because this is normally the location of the "hot" end of an initiator, extra material layers are preferred. The third fabric 124 preferably comprises at least one layer of polycarbonate material which hardens when impacted by a projectile along with the at least one layer of blast resistant and fragmentation resistant material. Preferably, the third fabric 124 comprises multiple layers of each material along with the pack 100 material to provide more protection around the initiators. In a most preferred embodiment, the third fabric 124 comprises a layer of blast resistant and fragmentation inhibiting material surrounded by two layers of polycarbonate material which hardens when impacted by a projectile surrounded by four layers of blast resistant and fragmentation inhibiting material surrounded by two layers of nylon.

The size of the pack 100 is dependent upon the users needs and may be selected by one skilled in the art. The pack 100 may also be configured with numerous pockets or pouches within both sections 102, 104, either fixed or removable, dependent upon user needs. For removable pouches or pockets, various fasteners, known in the art, such as hook and loop or molle fasteners may be employed. For use by explosive ordnance disposal technicians, it is preferred to include pouches for disposal tools, portable computers, portable GPS system, water containers, and other ordnance disposal needs.

Figure 4:
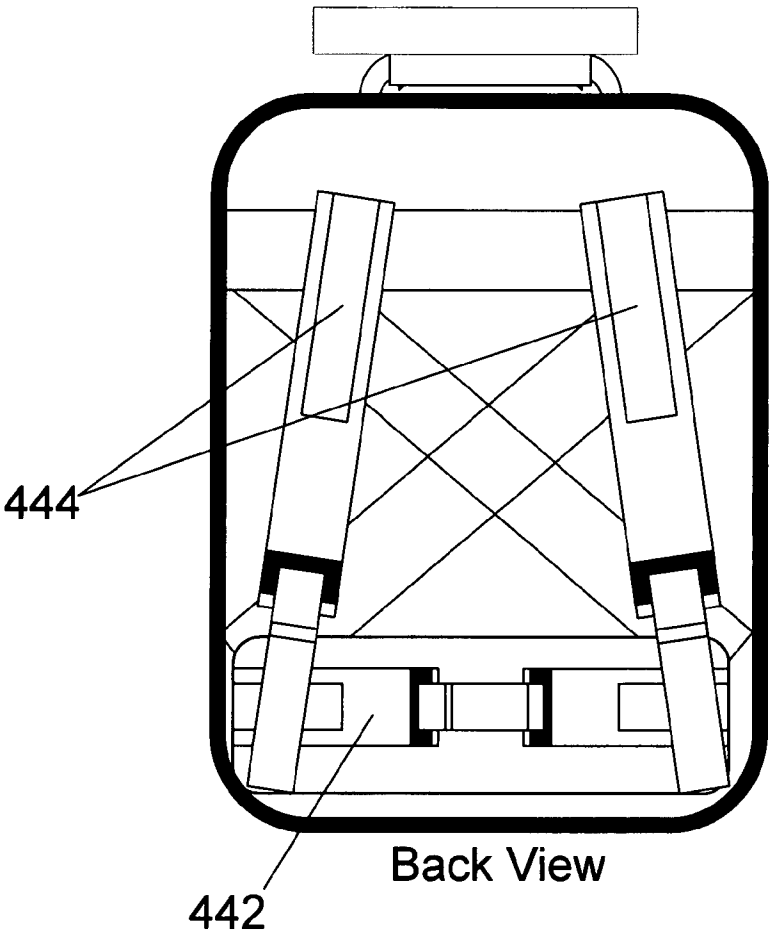
FIG. 4 shows a back view of the embodiment of the invention shown in FIG. 1.

Referring to FIGS. 3 and 4, the pack 100 is parachute jump certified. Attachment points 440 allow the pack 100 to be configured top up or inverted during a parachute jump. The pack 100 also has belt harness 442 to accompany the adjustable shoulder straps 444 to fully secure the pack 100 to the users back.

The invention also includes a safe method of transporting primary explosives and initiators that includes employing a pack as described herein and placing primary explosives within the energetic materials section and placing the initiators within the energetic initiator section. The particular configuration and materials of the pack, as described above, prevent initiation of the primary explosives via premature activation of one or more initiators.

What is described are specific examples of many possible variations on the same invention and are not intended in a limiting sense. The claimed invention can be practiced using other variations not specifically described above.

What is claimed is:

1. A pack to safely carry energetic materials and energetic initiators, comprising:

an energetic material section comprising a first opening and closure structure to close a first opening;

an energetic initiator section, comprising:

a second opening;

a second opening and closure structure to close the second opening;

a fabric comprising at least one layer of an electrically conductive material substantially surrounding the energetic initiator section including a back panel between the energetic material section and the energetic initiator section, said back panel comprising said electrically conductive material and at least one layer of a second material substantially adjacent said electrically conductive material for greater protection between the energetic initiator section and the energetic material section, wherein said back panel is internally situated within said pack.

2. The pack of claim 1, wherein the energetic initiator section further comprises an initiator containment panel, removably attached to the back panel, comprising at least one layer of said second material; a second fabric comprising at least one layer of said second material attached to the initiator containment panel forming a plurality of initiator holder pockets; and, a third fabric, substantially adjacent to a plurality of bottoms of the plurality of initiator holder pockets and adjacent to an outer edge of the pack, comprising at least one layer of said second material.

3. The pack of claim 2, wherein the plurality of initiator holder pockets further comprise two concentric plastic tubes comprising an air gap therebetween.

4. The pack of claim 2, wherein the initiator containment panel further comprises at least one layer of polycarbonate material, which hardens when impacted by a projectile.

5. The pack of claim 1, wherein the back panel comprises two layers of a nylon material, two layers of said second material, and one layer of said electrically conductive material therebetween.

6. The pack of claim 2, wherein the plurality of initiator holder pockets further comprises two layers of a nylon material comprising two layers of said second material therebetween.

7. The pack of claim 2, wherein the third fabric further comprises at least one layer of polycarbonate material, which hardens when impacted by a projectile.

8. The pack of claim 2, further comprising a plurality of initiator holder pocket tops, removeably attached to the plurality of initiator holder pockets, wherein the plurality of initiator holder pocket tops keep the initiators within the initiator holder pockets until the plurality of initiator holder pocket tops are removed.

9. The pack of claim 2, wherein the initiator containment panel comprises two layers of a polycarbonate material, which hardens when impacted by a projectile, surrounded by four layers of said second material, which is surrounded by two layers of nylon.

10. The pack of claim 2, wherein the third fabric comprises a layer of said second material surrounded by two layers of polycarbonate material, which hardens when impacted by a projectile, which is surrounded by four layers of said second material, which is surrounded by two layers of nylon.

11. The pack of claim 2, wherein the second opening and closure structure comprises a zipper covered by a flap of the second fabric.

12. The pack according to claim 1, wherein said second material of said back panel is intermediate said electrically conductive material and said energetic initiator section.

13. The pack according to claim 1, wherein said back panel is substantially parallel to said second opening and closure structure.

14. The pack according to claim 1, wherein said back panel is substantially parallel to said first opening and closure structure, and substantially parallel to said second opening and closure structure when closed.

15. The pack according to claim 1, wherein said energetic material section comprises a portion of said second material and said electrically conductive material intermediate said first opening and closure structure and said energetic initiator section.

16. A pack to carry energetic components, comprising:

an energetic material section comprising a first opening structure to close a first opening;

an energetic initiator section, comprising:

a second opening;

a second opening and closure structure to close the second opening;

a material comprising an electrically conductive layer substantially surrounding the energetic initiator section including a back panel between the energetic material section and the energetic initiator section, said back panel comprising said electrically conductive layer and a layer of second material substantially adjacent said electrically conductive layer for greater protection between the energetic initiator section and the energetic material section, wherein said back panel is internally situated within said pack.

* * * * *